US010753176B2

(12) United States Patent
Jimenez et al.

(10) Patent No.: US 10,753,176 B2
(45) Date of Patent: Aug. 25, 2020

(54) SWELLABLE TECHNOLOGY FOR DOWNHOLE FLUIDS DETECTION

(71) Applicant: Halliburton Energy Services, Inc., Houston, TX (US)

(72) Inventors: Walmy Cuello Jimenez, Houston, TX (US); John P. Singh, Humble, TX (US); Xueyu Pang, Houston, TX (US); Marcos Aurelio Jaramillo, Dickinson, TX (US); Krishna M. Ravi, Kingwood, TX (US); Thomas Jason Pisklak, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 242 days.

(21) Appl. No.: 15/757,569

(22) PCT Filed: Sep. 25, 2015

(86) PCT No.: PCT/US2015/052381

§ 371 (c)(1),
(2) Date: Mar. 5, 2018

(87) PCT Pub. No.: WO2017/052629

PCT Pub. Date: Mar. 30, 2017

(65) Prior Publication Data

US 2018/0245427 A1 Aug. 30, 2018

(51) Int. Cl.
*E21B 34/10* (2006.01)
*E21B 33/14* (2006.01)
(Continued)

(52) U.S. Cl.
CPC ..... *E21B 34/10* (2013.01); *E21B 21/10* (2013.01); *E21B 33/1208* (2013.01);
(Continued)

(58) Field of Classification Search
CPC ..... E21B 34/10; E21B 21/10; E21B 33/1208; E21B 47/06; E21B 47/18; E21B 33/14;
(Continued)

(56) References Cited

U.S. PATENT DOCUMENTS 4,756,952 A 7/1988 Sasayama
7,488,705 B2 2/2009 Reddy et al.
(Continued)

OTHER PUBLICATIONS

"PH-Responsive polymers: synthesis, properties and applications" by Dai et al. dated Jan. 21, 2008.
(Continued)

*Primary Examiner* — Wei Wang
(74) *Attorney, Agent, or Firm* — Thomas Rooney; C. Tumey Law Group PLLC

(57) ABSTRACT

A method of detecting the presence of a downhole fluid at a particular location in a wellbore including pumping an activating fluid into a wellbore; contacting a flow controlling device in a pipe string casing with the activating fluid, the flow controlling device comprising at least one swellable element; activating the at least one swellable element in the flow controlling device; blocking fluids or controlling the flow of fluids entering or leaving the casing with the activated flow controlling device; allowing the pressure to change; and detecting the pressure change. An apparatus includes a pipe string in a wellbore and a flow controlling device in the pipe string casing, wherein the flow controlling device includes at least one swellable element, wherein upon activation, the at least one swellable element swells and fully or partially seals off the flow area of the flow controlling device.

37 Claims, 9 Drawing Sheets

(51) Int. Cl.

| | |
|---|---|
| ***E21B 21/10*** | (2006.01) |
| ***E21B 33/12*** | (2006.01) |
| ***E21B 47/06*** | (2012.01) |
| ***E21B 47/18*** | (2012.01) |

(52) U.S. Cl.
CPC ..... *E21B 33/14* (2013.01); *E21B 47/06* (2013.01); *E21B 47/18* (2013.01)

(58) Field of Classification Search
CPC ..... E21B 34/08; E21B 47/0005; E21B 33/13; E21B 47/10; E21B 33/16; E21B 34/06
See application file for complete search history.

(56) References Cited

U.S. PATENT DOCUMENTS

| | | | | |
|---|---|---|---|---|
| 8,119,759 | B2 | 2/2012 | Edmiston | |
| 8,555,961 | B2 | 10/2013 | Koloy et al. | |
| 2003/0029611 | A1 | 2/2003 | Owens | |
| 2008/0011481 | A1 | 1/2008 | Badalamenti et al. | |
| 2008/0060803 | A1 | 3/2008 | Badalamenti et al. | |
| 2009/0090502 | A1 | 4/2009 | Lumbye et al. | |
| 2010/0212891 | A1 | 8/2010 | Stewart et al. | |
| 2015/0226012 | A1* | 8/2015 | Zhou ..... | E21B 7/00 175/57 |

OTHER PUBLICATIONS

International Search Report and Written Opinion for PCT/US2015/052381 dated Feb. 16, 2016.

* cited by examiner

SWELLABLE TECHNOLOGY FOR DOWNHOLE FLUIDS DETECTION

BACKGROUND

In primary cementing operations carried out in oil and gas wells, a hydraulic cement composition is disposed between the walls of the wellbore and the exterior of a pipe string, such as a casing string, that is positioned within the wellbore. The cement composition is permitted to set in the annulus thereby forming an annular sheath of hardened substantially impermeable cement therein. The cement sheath physically supports and positions the pipe in the wellbore and bonds the pipe to the walls of the wellbore whereby the undesirable migration of fluids between zones or formations penetrated by the wellbore is prevented.

One method of primary cementing involves pumping the cement composition down through the casing and then up through the annulus. In this method, the volume of cement required to fill the annulus must be calculated. Once the calculated volume of cement has been pumped into the casing, a cement plug is placed in the casing. A displacement fluid (e.g. drilling mud) is then pumped behind the cement plug such that the cement is forced into and up the annulus from the far end of the casing string to the surface or other desired depth. When the cement plug reaches a float shoe disposed proximate the far end of the casing, the cement should have filled the pre-designed or entire volume of the annulus. At this point, the cement is allowed to dry in the annulus into the hard, substantially impermeable mass.

As the drilling industry continues to shift towards harsher environments of high pressure and high temperature as a result of ultra-deepwater wells, mature fields, and unconventionals, formation's pore pressure and fracture gradient margins are becoming narrower. As a result, it has been found that due to the high pressure at which the cement must be pumped, at a pressure above the hydrostatic pressure of the cement column in the annulus plus the friction pressure of the system (ECD, Equivalent Circulating Density=$P_{hydrostatic}+P_{friction}$), fluid from the cement composition may leak off into a low pressure zone traversed by the wellbore, especially where the pore pressure/fracture gradient margins are very low. When such leak off occurs, the remainder of the cement composition near this low pressure zone is not sufficient to provide optimum zonal isolation to the required zone. Thereafter, remedial cementing operations, commonly referred to as squeeze cementing, must be used to place cement in the remainder of the annulus.

Accordingly, prior art attempts have been made to avoid the problems associated with fluid leak off into low pressure zones during cementing operations, especially for narrow margin cases. One method of avoiding such problems is called reverse cementing wherein the cement composition is pumped directly into the annulus. Using this approach, the pressure required to pump the cement to the far end of the annulus is much lower than that required in conventional cementing operations. Thus, significantly reducing the cement pumping pressure, and therefore the ECD, which in turns, diminishes the likelihood of fracturing the formation and having significant losses before the entire annulus or intended zone is filled with cement is significantly reduced.

It has been found, however, that with reverse cementing it is necessary to identify when the cement begins to enter the far end of the casing and reaches the desired depth inside the casing to leave the desired shoe track length such that the cement pumps may be shut off. Continuing to pump cement into the annulus after cement has reached the desired location after having crossed the far end of the casing, forces undesired amounts of cement into the casing, which in turn may necessitate additional drill out times.

One method of identifying when the cement has reached the far end of the annulus involves running a neutron density tool down the casing on an electric line. The neutron density tool monitors the density out to a predetermined depth into the formation. When the cement begins to replace the drilling mud in the annulus adjacent to the neutron density tool, the neutron density tool senses the change in density and reports to the surface that it is time to stop pumping additional cement into the annulus. Another method of identifying when the cement has reached the far end of the annulus involves running a resistivity tool and a wireless telemetry system down the casing on a wireline. The resistivity tool monitors the resistivity of the fluid in the casing such that when the cement begins to replace the drilling mud in the casing, a wireless signal is sent to the surface indicating it is time to stop pumping additional cement into the annulus.

It has been found, however, that use of such retrievable tool systems is prohibitively expensive. In fact, numerous neutron density tools and resistivity tools have been ruined during such operations as a result of the cement entering the far end of the casing and contacting these tools.

Therefore, a need has arisen for a system and method for cementing the annulus between the wellbore and the casing that does not require pumping the cement at pressures that allow for leak off into low pressure zones, especially for narrow margins operations. A need has also arisen for such a system and method that identify when to stop pumping additional cement into the wellbore. Further, a need has arisen for such a system and method that do not require the use of expensive equipment including tools that must be retrieved from the well once the cementing operation is complete.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

The present invention relates to detecting the presence of a particular material or fluid downhole, and the actions taken upon the detection. In particular, the invention relates to utilizing swellable materials to detect and react to the presence of certain materials downhole.

The present invention provides systems and methods for actuating a subterranean flow controlling device. Even though the systems and methods are described as being useful in actuating valves during reverse cementing, it should be understood by one skilled in the art that the systems and methods described herein are equally well-suited for actuating valves during other well operations and actuating downhole equipment other than valves.

Figure 1:
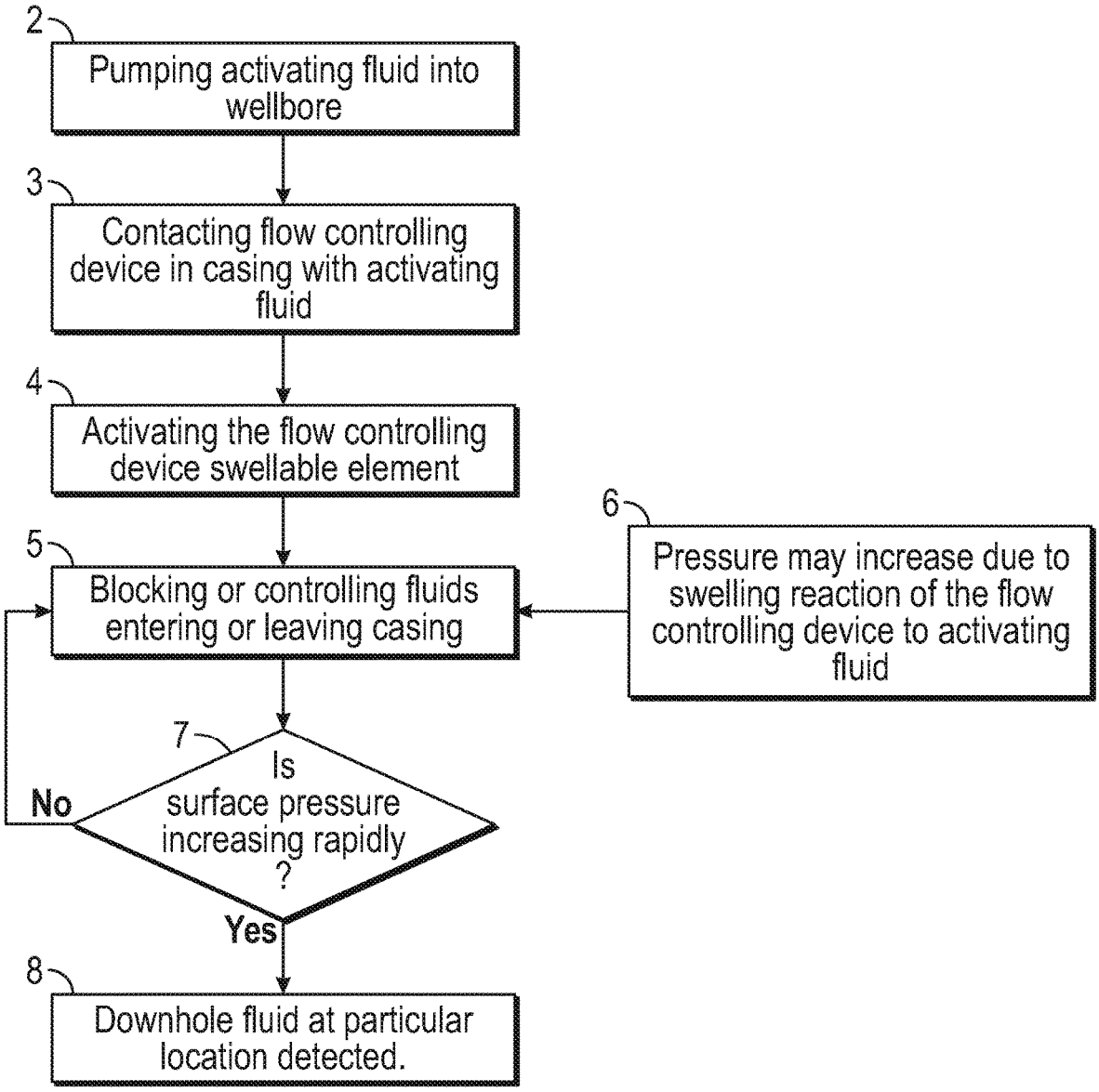
FIG. 1 is a flowchart of an embodiment of the disclosure.

FIG. 1 is a flowchart demonstrating a procedure for detecting the location of a downhole fluid in a wellbore according to an embodiment of the disclosure. In the procedure, an activating fluid is pumped into the wellbore 2. The activating fluid contacts a flow controlling device in a pipe casing 3, and activates a swellable element in the flow controlling device 4. The swelling of the element blocks or controls the fluids entering or leaving the casing 5, and may increase the pressure due to the swelling reaction of the flow controlling device to the activating fluid 6. The surface pressure is monitored at the surface 7. If the surface pressure does not increase, then the surface pressure continues to be monitored 7. If the surface pressure does increase, then the downhole fluid has been detected at a particular location 8.

Electronic-less devices are an advantage of the methods and devices of this disclosure. In many embodiments, the devices and methods do not required downhole wire communication, or any other type of downhole communication, making it very suited for downhole fluid detection applications. The advantages may reduce wasted time sending and or retrieving wireline equipment from downhole. A further advantages is not having to depend on the reliability of electronics in the downhole environment.

One embodiment of the disclosure is directed to a method of detecting the presence of a downhole fluid at a particular location in a wellbore comprising pumping an activating fluid into a wellbore comprising a pipe string casing;

contacting a flow controlling device in the pipe string casing with the activating fluid, the flow controlling device located in the pipe string casing, and the flow controlling device comprising at least one swellable element, wherein upon activation, the at least one swellable element swells and partially or fully seals off the flow area of the flow controlling device, therefore, controlling at least one of flow rate, pressure, and combinations thereof; activating the at least one swellable element in the flow controlling device thereby creating an activated flow controlling device; blocking fluids or controlling the flow of fluids entering or leaving the casing with the activated flow controlling device; allowing the pressure to change; and detecting the pressure change. In an embodiment, the flow controlling device is a valve. In one embodiment, the at least one swellable element includes at least one of pH responsive materials, hydrogels, polyelectrolytes, and combinations thereof. The activating may include at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof. In an embodiment, the method further comprises multiple flow controlling devices at different locations, resulting in a series of pressure pulses that are communicated to the surface as a result of multiple pressure events created by the multiple swelling multiple flow controlling devices. In another embodiment, the flow controlling device is a collar valve or shoe valve, or any other type of valve located at any desired location within the casing string. In an embodiment the swellable element of the valve comprises swellable material on at least one of the head of the valve, the tail of the valve, and combinations thereof. The method may further comprise deactivating the swellable element. In another embodiment, the deactivating comprises pumping a fluid into the wellbore that causes the shrinking of the swellable element.

One embodiment of the disclosure is directed to a method of cementing in a wellbore comprising pumping an activating fluid through an annulus between a pipe string and the wellbore or through the pipe string casing; pumping at least one of a cement slurry, resin based fluid, and combinations thereof through, an annulus between a pipe string and the wellbore or through the pipe string casing; contacting a flow controlling device in the pipe string casing with the activating fluid, the flow controlling device comprising at least one swellable element, wherein upon activation, the at least one swellable element swells and partially or fully seals off the flow area of the flow controlling device, therefore, controlling at least one of the flow rate, pressure, and combinations thereof; activating the at least one swellable element in the flow controlling device thereby creating an activated flow controlling device; and blocking or controlling the activating fluid with the activated flow controlling device. In an embodiment, the cement slurry and the activating fluid are pumped through the pipe string casing, and the at least one of a cement slurry and resin based fluid is pumped before the activating fluid. The method may further comprise placing a cement plug in the casing between the pumping of the at least one of a cement slurry and resin based fluid and the pumping of the activating fluid. In another embodiment, the at least one of a cement slurry and resin based fluid and the activating fluid are pumped through the annulus between the pipe string and the wellbore, and the activating fluid is pumped before the at least one of a cement slurry and resin based fluid. In an embodiment, the activating fluid is also the at least one of a cement slurry and resin based fluid. In one embodiment, the flow controlling device is a valve. In an embodiment, the at least one swellable element includes at least one of pH responsive materials, hydrogels, polyelectrolytes, and combinations thereof. The activating may include at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof. In one embodiment, the method further comprises allowing the pressure to change and detecting the pressure change. In an embodiment, the detecting comprises monitoring the surface pressure for increases in pressure. The method may further comprise multiple flow controlling devices at different locations, resulting in a series of pressure pulses that are communicated to the surface as a result of multiple pressure events created by the multiple swelling multiple flow controlling devices. In an embodiment, the method further comprises adjusting the flow of the at least one of a cement slurry and resin based fluid when the surface pressure increases rapidly or series of pressure pulses are communicated to the surface. The method may further comprise at least one of stopping the flow of the at least one of a cement slurry and resin based fluid, adjusting the flow of the at least one of a cement slurry and resin based fluid, and combinations thereof. In another embodiment, the method further comprises pumping a displacement fluid through the annulus behind the at least one of a cement slurry and resin based fluid before the at least one of a cement slurry and resin based fluid has contacted the valve. In some embodiments, the valve may be a collar valve or a shoe valve, which can be located at any desired location inside the casing string. The swellable element of the valve may comprise swellable material on at least one of the head of the valve, the tail of the valve, and combinations thereof. The at least one of a cement slurry and resin based fluid may comprise at least one of an additive, a tracer, and combinations thereof, that activates the at least one swellable element. In an embodiment, the method further comprises deactivating the swellable element. In an exemplary embodiment, the deactivating comprises pumping a fluid down the casing or the annulus that causes the shrinking of the swellable element.

An embodiment of the disclosure is directed an apparatus for blocking or controlling fluid flow in a wellbore, the apparatus comprising: a pipe string in a wellbore; and a flow controlling device in the pipe string casing, wherein the valve comprises at least one swellable element, wherein upon an activating trigger, the at least one swellable element swells and partially or fully seals off the flow area of the flow controlling device, thereby blocking or controlling the flow of fluids into or out of the pipe string.

In some embodiments, the flow controlling device is a valve. The at least one swellable element may include at least one of pH responsive materials, hydrogels, polyelectrolytes, and combinations thereof. The activating trigger may include at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof. In some embodiments, the valve may be a collar valve or a shoe valve. The swellable element of the valve may comprise swellable material on at least one of the head of the valve, the tail of the valve, and combinations thereof.

Figure 2:
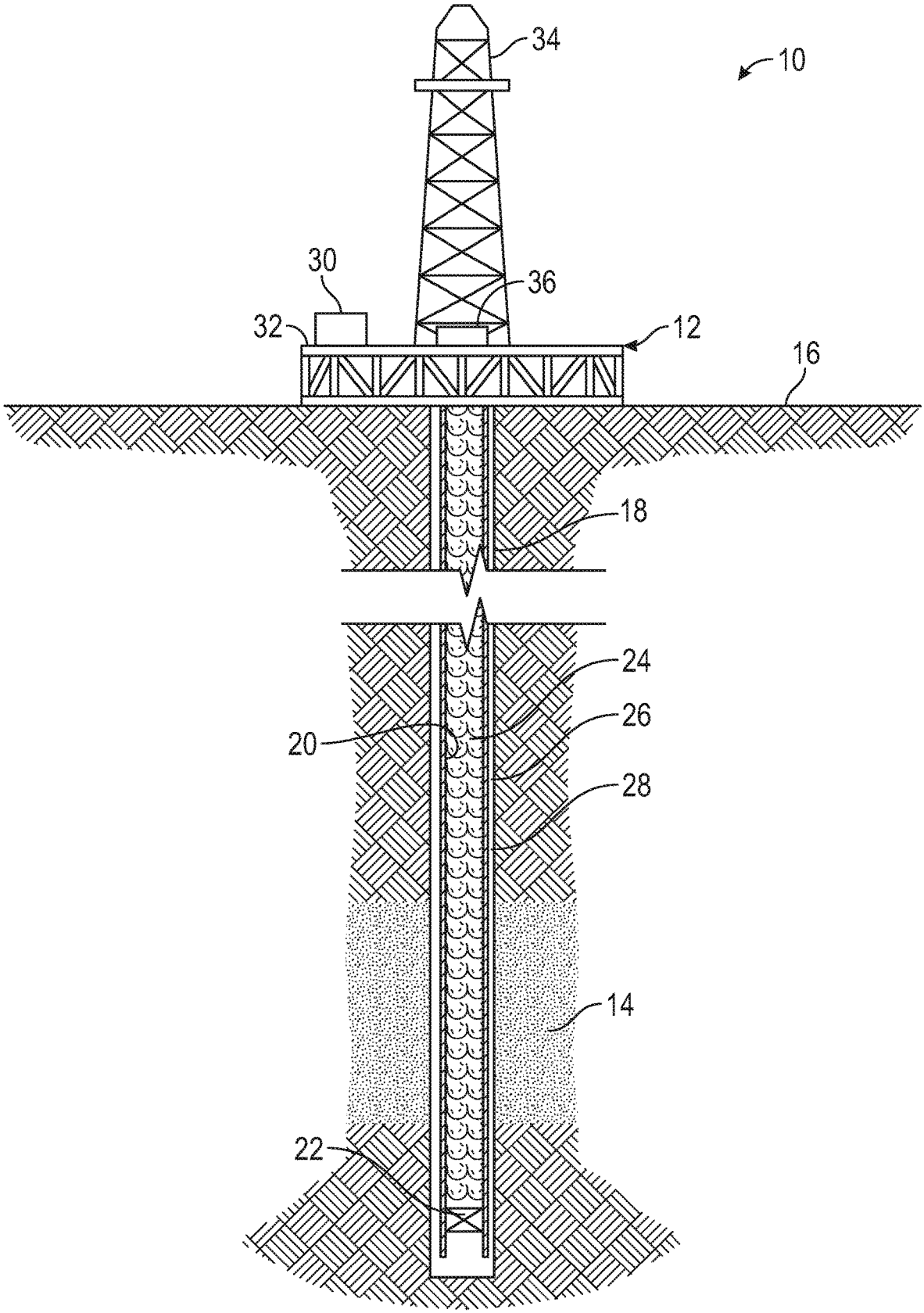
FIG. 2 is a schematic illustration of an onshore oil or gas drilling rig operating a system for actuating a subterranean valve to terminate a cementing or reverse cementing operation of the present invention.

A system for generating a pressure spike or pressure pulses when a downhole fluid is present at a particular location in a wellbore comprises: an apparatus comprising: a pipe string in the wellbore; and a flow controlling device in the pipe string casing near the bottom of the wellbore, wherein the valve comprises at least one swellable element, wherein upon an activating trigger, the at least one swellable element swells and partially or fully seals off the flow area of the flow controlling device, thereby blocking or controlling the flow of fluids into or out of the pipe string; pumping an activating fluid into the wellbore; pumping a downhole fluid into the wellbore; contacting a flow controlling device in the pipe string casing with the activating fluid; activating the at least one swellable element in the flow controlling device thereby creating an activated flow controlling device; blocking or controlling the flow of downhole or activating fluids entering or leaving the casing with the activated flow controlling device; and allowing the pressure to spike or pulse. The system may further comprise detecting the pressure spike or pulse on the surface of the wellbore. In an embodiment, the detection of the pressure spike or pulse indicates that a downhole fluid is present near a certain downhole location. In an embodiment, the indication that the downhole fluid is present near a certain downhole location is performed without wired downhole communications. As shown in FIG. 2, an onshore oil or gas drilling rig operating a system for actuating a subterranean valve to terminate a cementing or reverse cementing operation of the present invention is schematically illustrated and generally designated 10. A similar rig may also be used for offshore drilling. Rig 12 is centered over a subterranean oil or gas formation 14 located below the earth's surface 16. A wellbore 18 extends through the various earth strata including formation 14. Wellbore 18 is lined with a casing string 20. Casing 20 has a valve 22 that is disposed proximate the far end of casing 20 or at any other desired location. Valve 22 is used to selectively permit and prevent the flow of fluids therethrough. For example, during a reverse cementing operation, valve 22 remains open as drilling fluids 24 is forced from annulus 26 into the far end of casing 20 when cement 28 is pumped, via cement pump 30, into the near end of annulus 26. When the leading edge of cement 28 reaches the far end of casing 20 or the desired location, valve 22 is closed to prevent an excessive amount of cement 28 from traveling within casing 20. Thereafter, cement 28 is allowed to set in annulus 26 to form a hard, substantially impermeable mass which physically supports and positions casing 20 in wellbore 18 and bonds casing 20 to the walls of wellbore 18.

Rig 12 includes a work deck 32 that supports a derrick 34. Derrick 34 supports a hoisting apparatus 36 for raising and lowering pipe strings such as casing 20. Pump 30 on work deck 32 is of conventional construction and is of the type capable of pumping a variety of fluids into the well. Pump 30 includes a pressure measurement device that provides a pressure reading at the pump discharge.

In cementing operations, typically a portion of cement is left in the casing (known as shoe track), typically 80 ft (two casing joints), this may vary depending on conditions and software simulations. This may ensure that no contaminated cement remains in the annulus, where optimum isolation is required.

The detection apparatus of the present disclosure is flexible enough to be located at the desired casing joint in such a way that the desired shoe track length is left inside the casing. If the detection is not made properly or not make at all, the shoe track may either be too long requiring additional drill out time, or too short, potentially compromising the integrity of the cement at the lower depths.

Figure 4A:
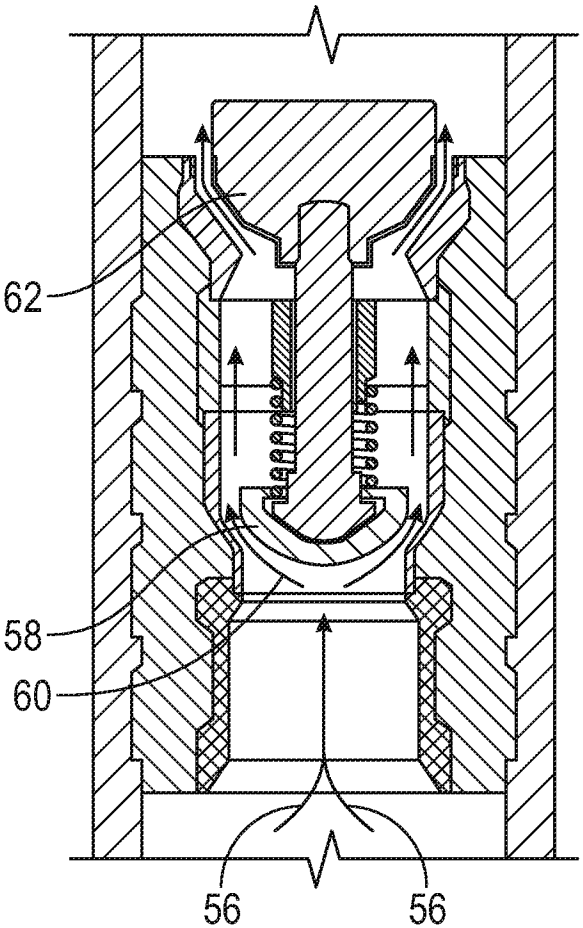
FIGS. 4A-C illustrate the mechanism for actuating the self-actuating subterranean valve under various triggering conditions.
Figure 3:
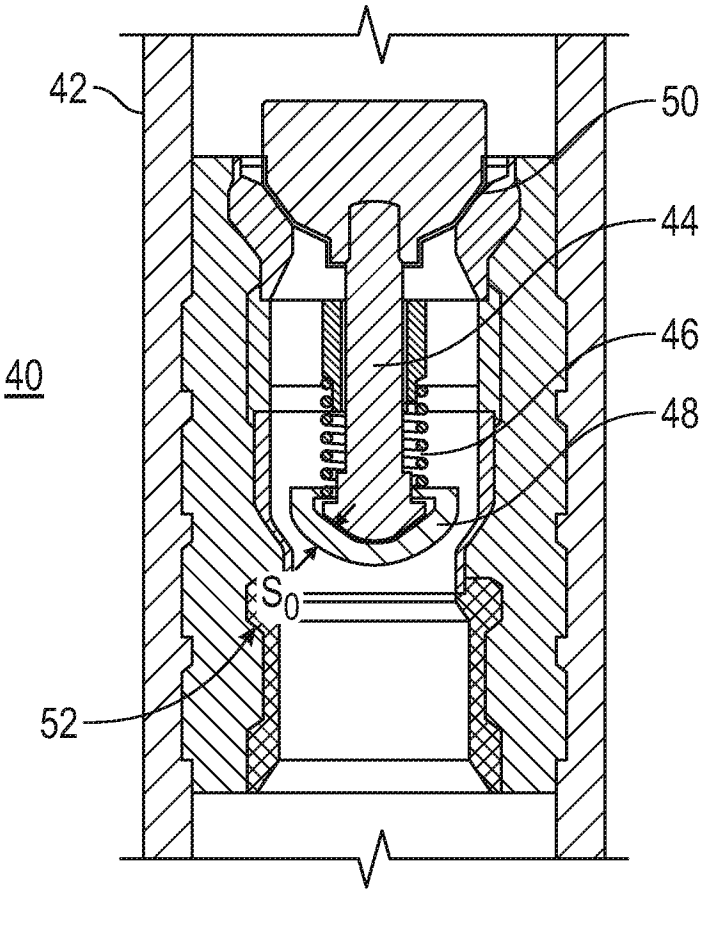
FIG. 3 is schematic illustration of a self-actuating subterranean valve.
Figure 4C:
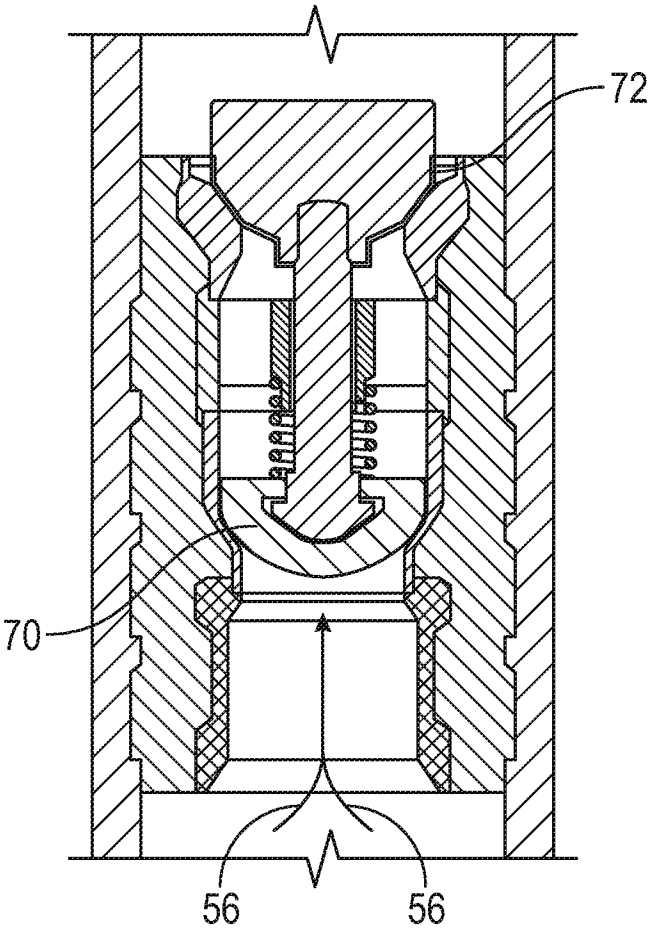
Figure 4B:
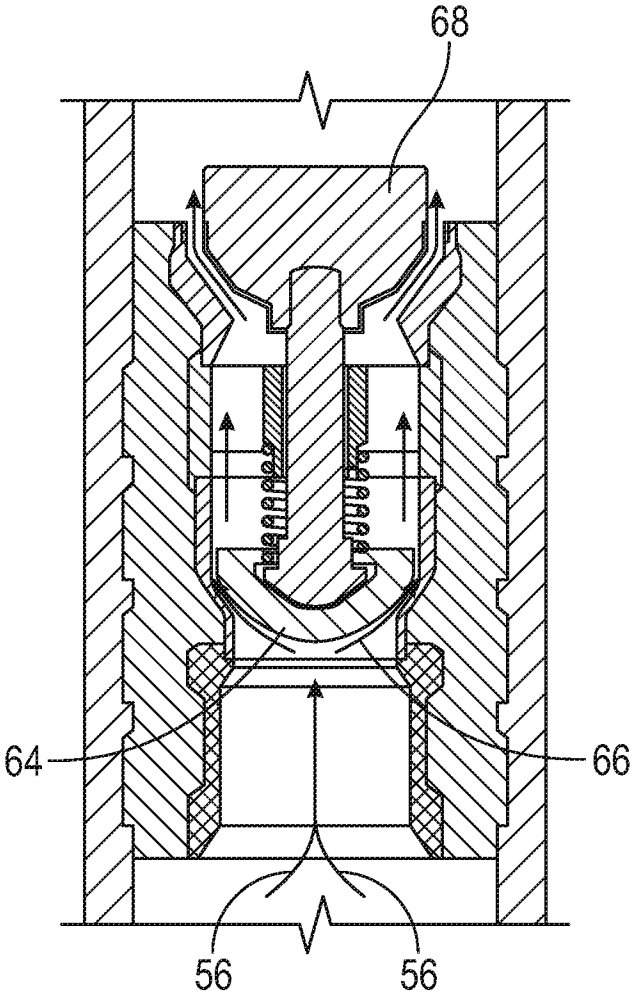

FIG. 3 illustrates a valve 40 according to embodiments of the disclosure. Valve 40 is located on collar or shoe 42. The valve assembly 44 may include a spring 46, as well as a first swellable element 48 and an optional second sellable element 50. In an embodiment, first swellable element 48 has an un-swelled thickness 52 of $S_0$ prior to exposure to an activating fluid, an activated fluid can be cement itself, or any other fluid predesigned for such function and desired reactivity. FIGS. 4A,B,C demonstrate what happens to the swellable elements after they are exposed to an activating fluid. In FIG. 4A, activating fluid 56 has just started to activate the swellable elements 58,62. The fluid 56 is still flowing 60 into the casing. At this point, time=$t_0$, swellable thickness=$S_0$, and pressure=$P_0$, where the pressure is measured between the discharge of the pump and the entrance to the valve at the bottom of the casing. As shown in FIG. 4B, activating fluid 56 continues to cause swellable elements 64,68 to swell and slowly or immediately block off the flow 66 of activating fluid into the casing. At this point, time=$t_1$, swellable thickness=$S_1$, and pressure=$P_1$. FIG. 4C shows the state of the valve after the swellable elements 70,72 have fully swelled. No activating fluid 56 is allowed to flow into the casing. At this point, time=$t_f$, swellable thickness=$S_f$, and pressure=$P_f$.

Figure 5A:
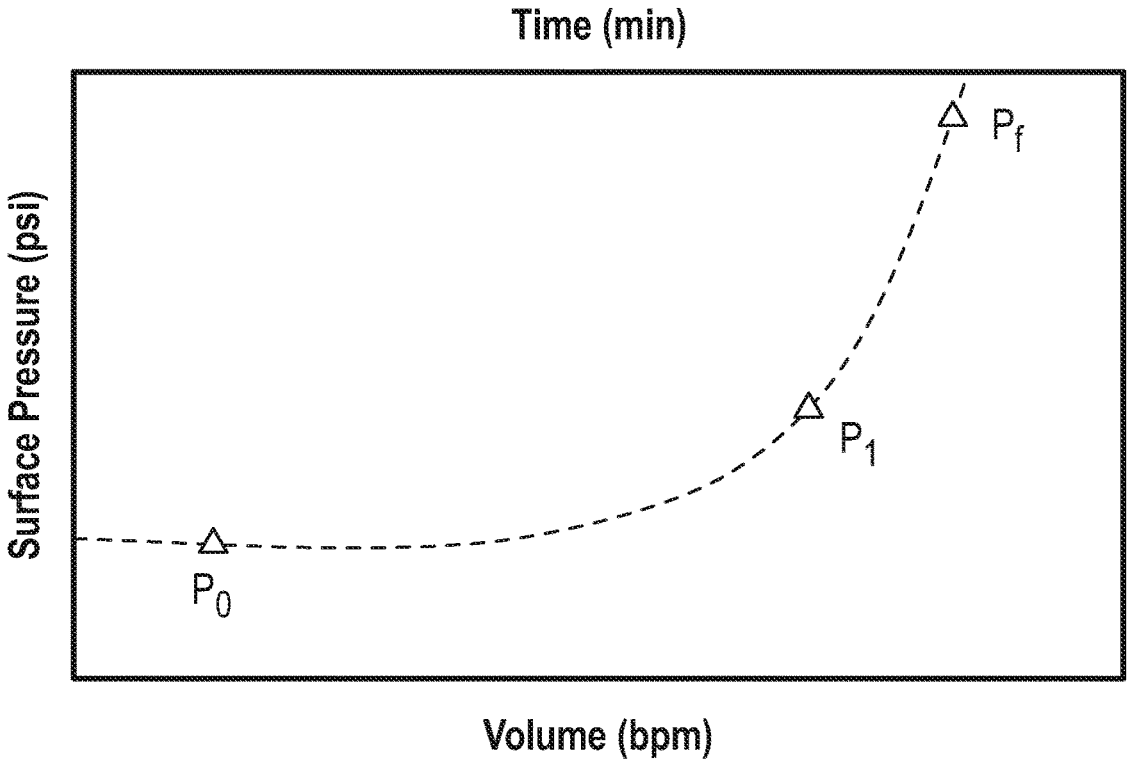
FIGS. 5A,B illustrate the change in surface pressure and the swellable thickness of the swellable members of a valve upon activation.
Figure 5B:
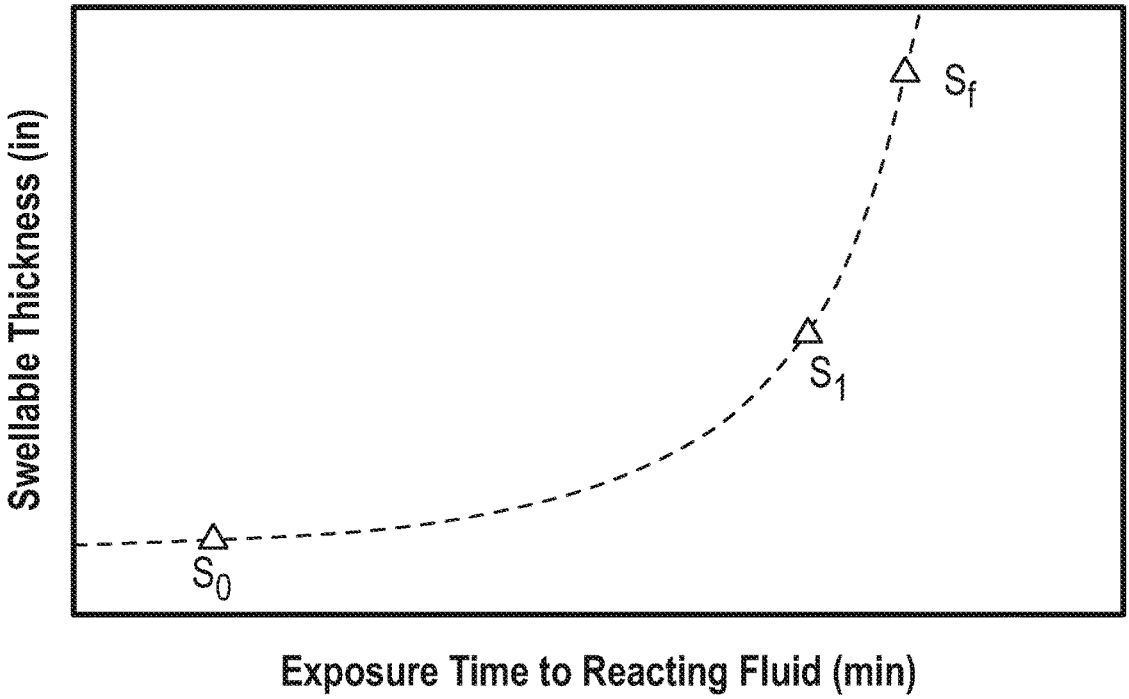

As illustrated in FIG. 5A,B, as the swellable element thickness S increases, the surface pressure P increases with the results illustrating that $P_f>P_1>P_0$. When the surface pressure has increased to $P_f$, the pump on the surface may be shut off. This may occur by either an automatic control shutoff based on a predetermined maximum pressure, or by operator intervention.

Figure 6B:
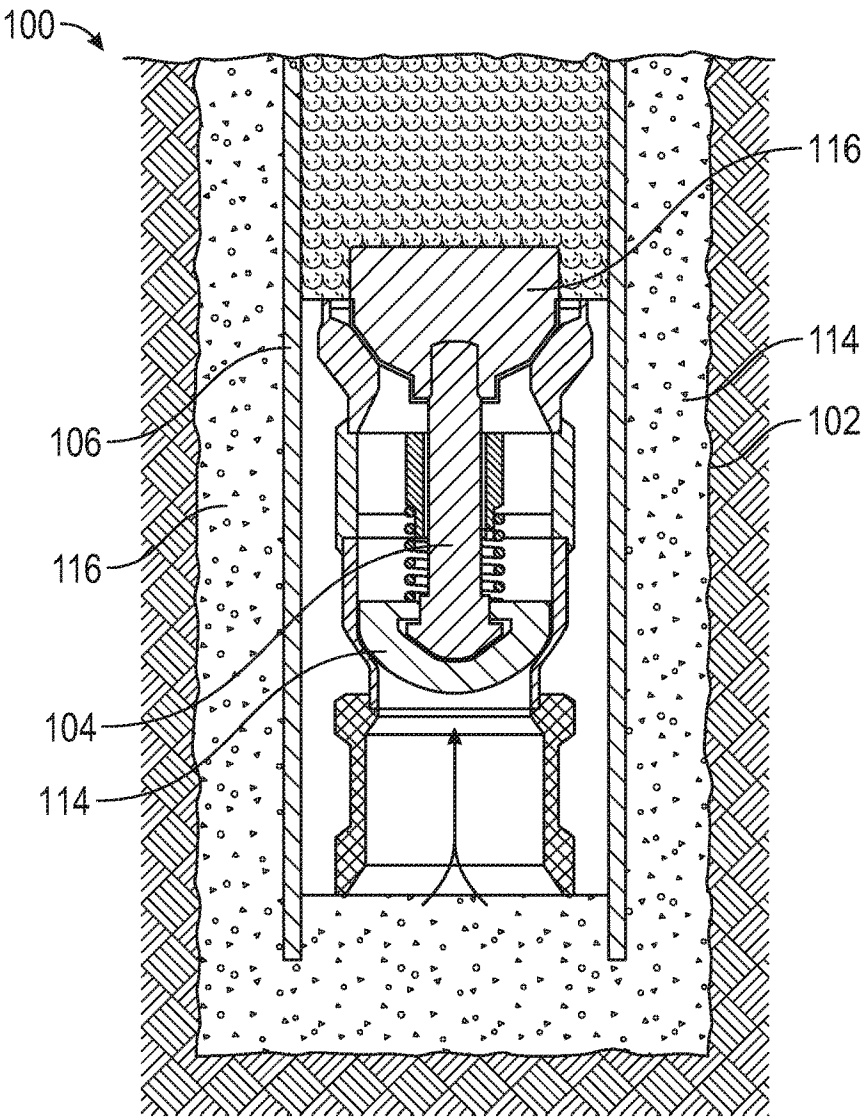
FIGS. 6A,B illustrate a reverse cementing operation according to embodiments of the disclosure.
Figure 6A:
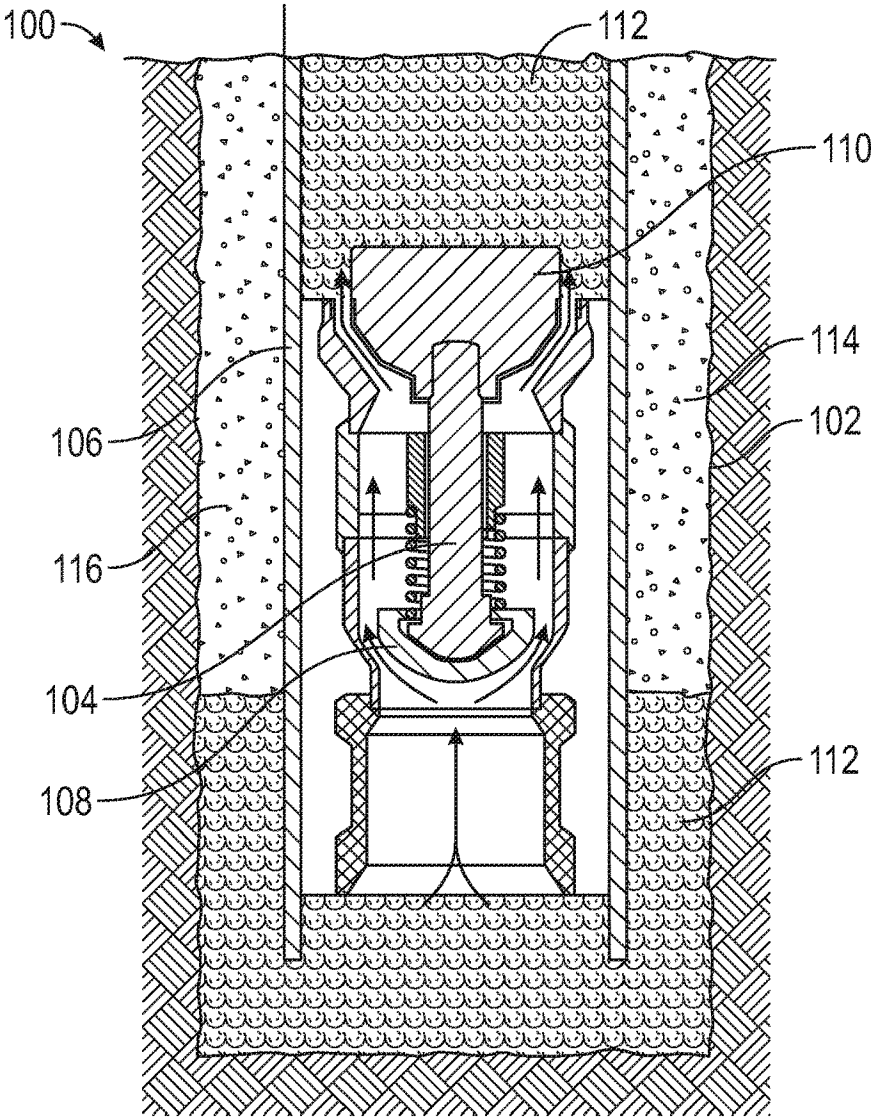

Referring to FIG. 6A, the valve system 100 is located within wellbore 102, with the valve 104 located within casing 106. Valve 104 is shown in the open position with swellable elements 108, 110 in contact with a non-activating fluid 112. In some embodiments, the non-activating fluid 112 is a drilling fluid, and flows through valve 104 into casing 106. Cement composition 114 is pumped through annulus 116 toward the bottom of casing 106 and into valve 104. As illustrated in FIG. 6B, upon cement composition 114 contacting swellable elements 108, 110 of valve 104, the swellable elements swell 114, 116, and close valve 104. Cement composition 114 is prevented from entering the portion of the casing 106 above the valve 104.

Figure 7B:
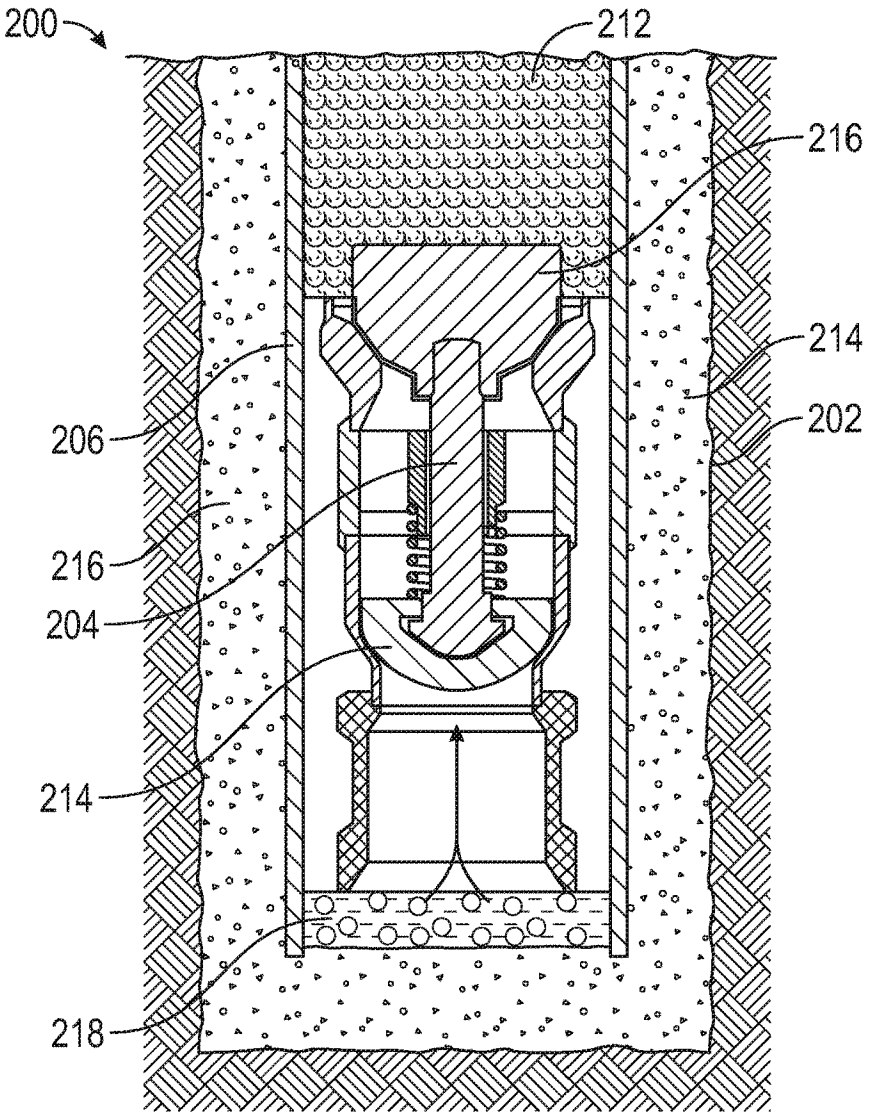
FIGS. 7A,B illustrate a reverse cementing operation including an activating fluid according to embodiments of the disclosure.
Figure 7A:
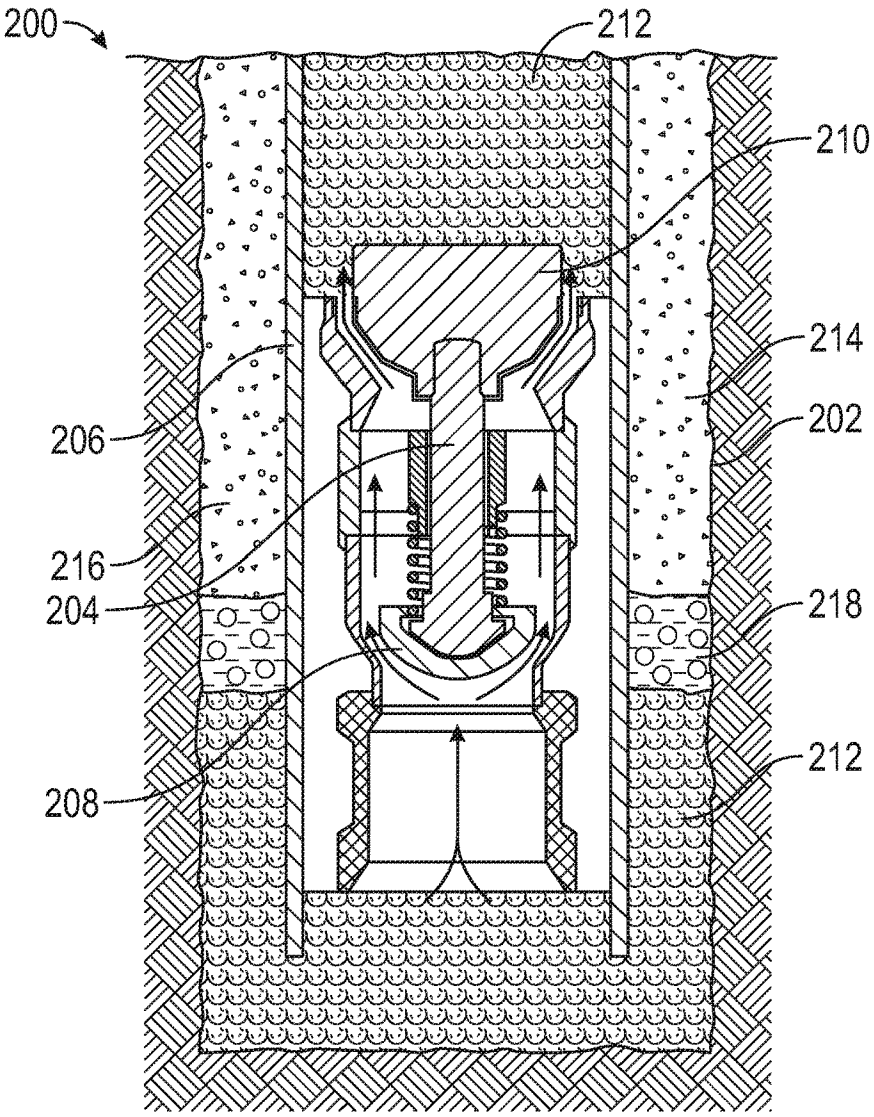

In another embodiment, an activating fluid, separate from the cement composition, is utilized to trigger the swellable valve elements. As illustrated in FIG. 7A, the valve system 200 is located within wellbore 202, with the valve 204 located within casing 206. Valve 204 is shown in the open position with swellable elements 208, 210 in contact with a non-activating fluid 212. In some embodiments, the non-activating fluid 212 is a drilling fluid, and flows through valve 204 into casing 206. Activating fluid 218 is pumped through annulus 216 toward the bottom of casing 206 and into valve 204. Following the activating fluid 218 is cement composition 214, which is pumped through annulus 216 toward the bottom of casing 206. As illustrated in FIG. 7B, upon activating fluid 218 contacting swellable elements 208, 210 of valve 204, the swellable elements swell 214, 216, and close valve 204. Cement composition 214 is prevented from entering the portion of the casing 206 above the valve 204.

Figure 8:
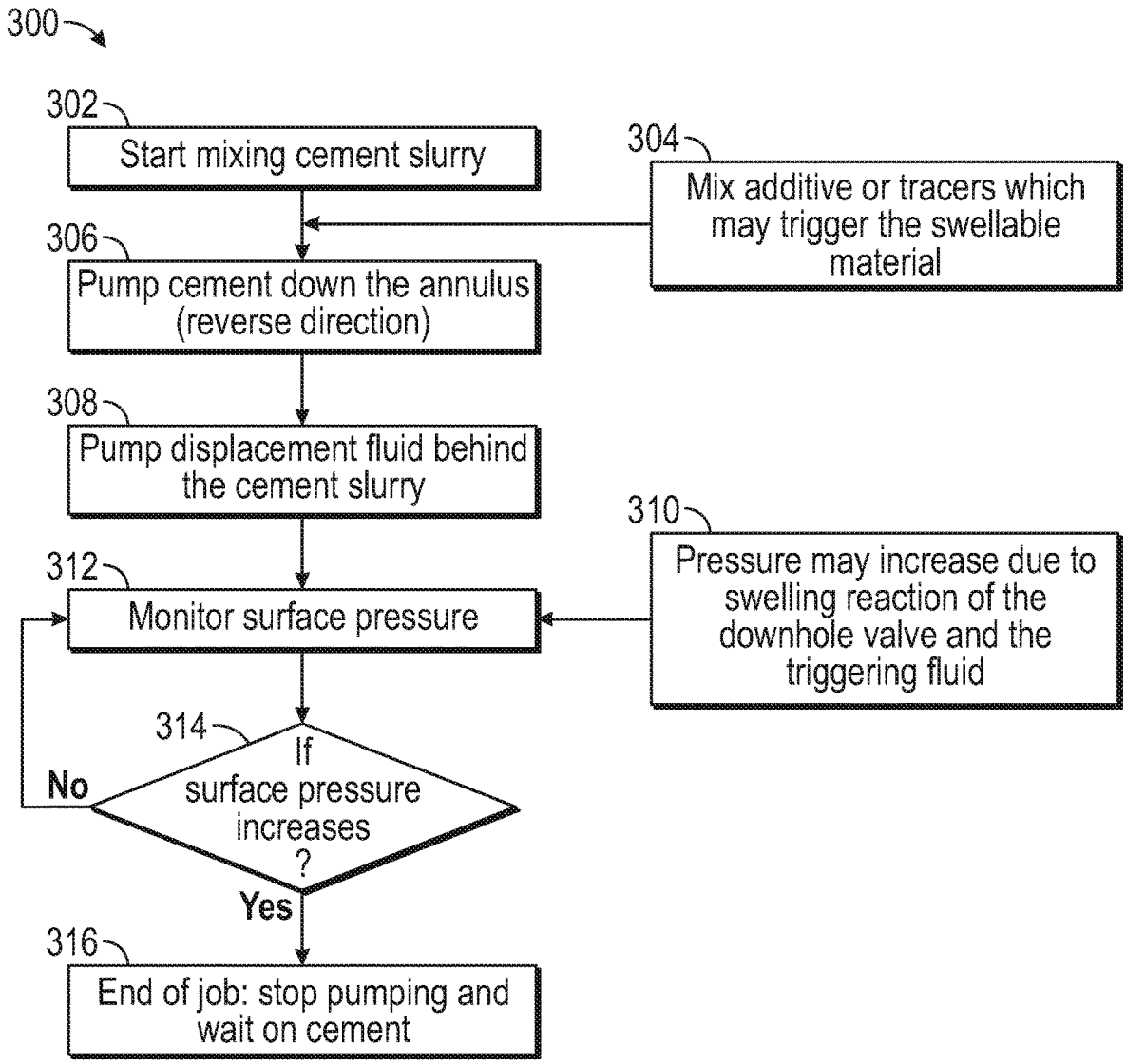
FIG. 8 is a flowchart of a reverse cementing operation according to embodiments of the disclosure.

FIG. 8 is a flowchart demonstrating a procedure for carrying out a reverse cementing operation. In the reverse cementing operation 300, the cement slurry is mixed 302 and additional additives or tracers which may trigger the swellable elements may be added at 304. Next, the cement is pumped down the annulus 306 and a displacement fluid is pumped behind the cement slurry 308. The surface pressure may increase due to the swelling of the downhole valve elements being triggered by the additives or by the cement 310. The pressure is monitored at the surface 312. If the surface pressure does not increase 314, then the surface pressure is continued to be monitored 312. If the surface pressure does increase 314, then the reverse cementing job then the pump is turned off 316 and the job is complete upon the curing of the cement.

Multiple devices may be placed along the casing string with different expected expansion capabilities (maximum to minimum expansion valves placed from top to bottom) in order to generate multiple signals (pressure spikes) to surface as redundancy measure or binary communication (i.e., pressure pulses) of the detection action.

In a further embodiment, the swellable fluid controlling device can be designed in such way to also avoid back flow of annular fluids into the casing, thus, avoiding the calculation and application of back pressure during cement hydration to prevent back flow.

Flow Controlling Devices

The methods and apparatuses of the disclosure include a flow controlling device. In some embodiments, this device resided in the casing near the bottom of a wellbore or at any other desired location. In one embodiment, the device is a valve, as illustrated in the sections above. Any valve of suitable construction may be used, such as ball valves, sleeve valves, butterfly valves, check valves, choke valve, diaphragm valve, pressure reducing valve, thermal expansion valve, electro-rheological valves but not limited thereto.

Figure 9A:
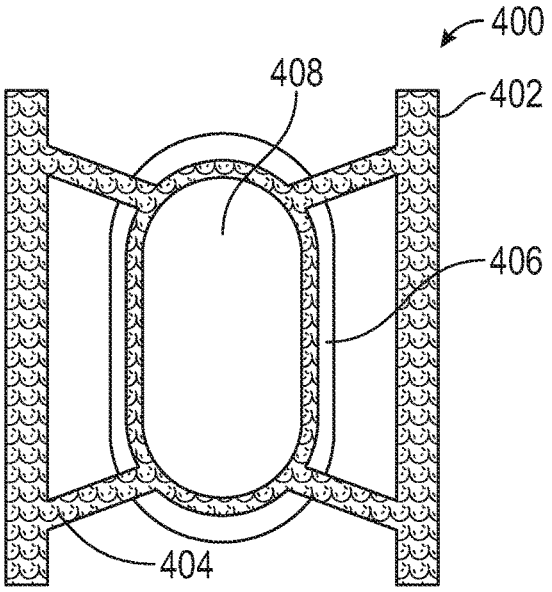
FIGS. 9A-C are illustrations of flow control devices according to embodiments of the disclosure.
Figure 9B:
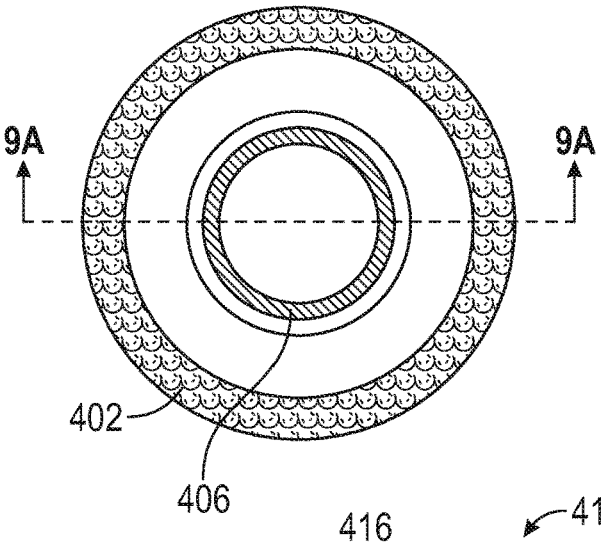
Figure 9C:
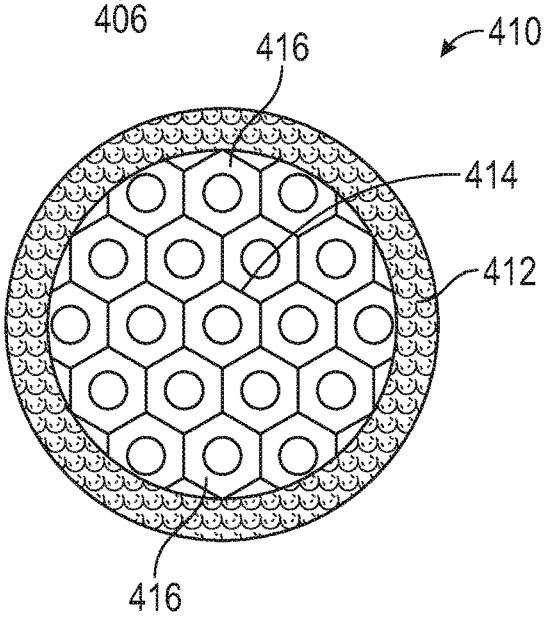

FIGS. 9A-C illustrate alternative flow controlling devices. A capsule shaped device coated with swellable material is shown in FIG. 9A and cross-section 9B. The device 400 includes a casing 402, bracing 404, and a swellable coating 406 surrounding a capsule 408. Upon contact with an activating fluid, the swellable coating 406 swells, closing off a path for fluid flow.

FIG. 9C illustrates the cross-section of a honeycomb shaped device with a swellable coating therein. Device 410 includes a casing 412 as well as an array hollow cells 414, each containing swellable coatings 416 on the walls of each individual cell 414. Upon contact with an activating fluid, the swellable coatings 416 swell and fully or partially close off the cells to fluid flow.

Triggers

The methods and apparatuses of the disclosure may be activated by a triggering event. The trigger may be chemical, physical, or both in nature. Chemical triggers include pH change, oxidation and reduction, solvent exchange, ionic strength change, oil-based change. Certain materials are sensitive to changes in pH, such as an alkaline sensitive latex material. This material swells upon exposure to high pH fluids, such as cement. A drilling mud of pH of about 7 would be displaced with a cement of about pH 11-13, causing the material to swell. The material may also shrink when exposed to a low pH such as an acid pill for reversible effects.

Physical triggers may include light irradiation, temperature change, physical deformation, magnetic field application, electric field application, microwave irradiation, temperature, pressure gradients, and combinations thereof.

Swellable Materials

The methods and apparatuses of the disclosure include swellable materials. The material may be any material that swells when exposed to one of the triggers above. Typically, the dimensions of the swellable materials applied to a controlling device are such that when this material completely swells, the flow area is completely or partially sealed depending on the design requirements.

A useful swelling material is a pH-responsive polymer, as disclosed by Dai et al. in *Soft Matter,* 2008, 4, 435-449. The solubility, volume, configuration, and conformation of a pH-responsive polymer may be reversibly manipulated by changes in external pH. Most pH-responsive polymers and microgels are synthesized through batch emulsion polymerization using water-soluble initiators. Additionally, pH-responsive polymers may be produced using controlled polymerization techniques, such as anionic polymerization and group transfer polymerization.

Another useful swelling material is an Alkali swellable latex, which may defined as a latex emulsion that, when exposed to pH increasing materials, may swell and exhibit an increase in viscosity. Alkali swellable latexes typically contain, in addition to the typical latex forming monomers, monomers having acidic groups capable of reacting with pH increasing materials thereby forming anionic pendant groups on the polymer back bone. Alkali swellable latex emulsions, due to the presence of acidic groups, have a pH in the range of from about 2 to about 8 and are predominantly low viscosity fluids with viscosities less than about 100 centipoise for an emulsion containing 30% solids. When the pH is increased by the addition of a pH increasing material, the viscosity increase may be in the range of from about five times to more than about a million times for a 30% emulsion. The conventional latex emulsion does not significantly increase in viscosity upon the addition of a pH increasing material. In some embodiments, the latex emulsion may be cross-linked during the polymerization phase of the monomers. Examples of typical latex forming monomers that may be used to make alkali swellable latexes include, without limitation, vinyl aromatic monomers (e.g., styrene based monomers), ethylene, butadiene, vinylnitrile (e.g., acrylonitrile), olefinically unsaturated esters of $C_1$-$C_8$ alcohol, or combinations thereof. In some embodiments, nonionic monomers that exhibit steric effects and that contain long ethoxylate or hydrocarbon tails may also be present. The monomers containing acid groups capable of reacting with pH increasing materials include ethylenically unsaturated monomers containing at least one carboxylic acid functional group. Such carboxylic acid containing monomers may be present in the range of from about 5 to about 30% by weight of the total monomer composition used in preparing the alkali swellable latex. Without limitation, examples of such carboxylic acid containing groups include acrylic acid, alkyl acrylic acids, such as methacrylic acid and ethacrylic acid, alpha-chloro-acrylic acid, alpha-cyano acrylic acid, alpha-chloro-methacrylic acid, alpha-cyano methacrylic acid, crotonic acid, alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, or combinations thereof. In an embodiment, the carboxylic acid containing groups can include itaconic acid, acrylic acid, or combinations thereof.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004/0020662.

The water-swellable polymeric material may be a rubbery blend comprising natural rubber (NR) or a synthetic rubber, such as a synthetic cis-1,4 polyisoprene rubber (IR), polybutadiene rubber (BR), random-copolymerized rubber of styrene and a dienic monomer (SBR or SIR), copolymeric rubber of acrylonitrile and a dienic monomer (NBR or NIR), chloroprene rubber (CR), copolymeric rubber of isobutylene and isoprene (IIR), ternary copolymeric rubber of ethylene, propylene and a dienic monomer (EPDM), poly(trans-1,4-isoprene) rubber, block-copolymerized rubber of styrene and a dienic monomer and the like, highly water absorptive resin, vulcanizing agent, vulcanization accelerator, filler, aging retarder and the like.

Alternatively, the water-swellable polymeric material may be a blend of a synthetic resin having flexibility, such as chlorinated polyethylenes, copolymers of ethylene and vinyl acetate, plasticized polyvinyl chloride resins, polyurethanes and the like, with a highly water absorptive resin and other additives.

Other materials include swellable sol-gels such as those disclosed in U.S. Pat. No. 8,119,759, which are activated upon exposure to a non-polar sorbate.

Cement Slurry

A variety of cements can be used in the present invention, including cements comprised of calcium, aluminum, silicon, oxygen, and/or sulfur which set and harden by reaction with water; or those such as resin-based systems that also have at least two components that react and harden over time. Such hydraulic cements include Portland cements, gypsum cements, high alumina content cements, slag cements, high magnesia content cements, shale cements, acid/base cements, fly ash cements, zeolite cement systems, kiln dust cement systems, microfine cements, metakaolin, pumice and their combinations, along with resin-based systems. In some embodiments, the suitable API Portland cements are from Classes A, C, H, and G.

The cement compositions of the invention may contain additives. In certain embodiments, the additives comprise at least one of resins, latex, stabilizers, silica, pozzolans, microspheres, aqueous superabsorbers, viscosifying agents, suspending agents, dispersing agents, salts, accelerants, surfactants, retardants, defoamers, settling-prevention agents, weighting materials, fluid loss control agents, elastomers, vitrified shale, gas migration control additives, formation conditioning agents, and combinations thereof.

In certain embodiments, the cement compositions have a slurry density which is pumpable for introduction down hole. In exemplary embodiments, the density of the cement composition in slurry form is from about 7 pounds per gallon (ppg) to about 20 ppg, from about 8 ppg to about 18 ppg, or from about 9 ppg to about 17 ppg.

Displacement Fluid

The displacement fluid may include an aqueous base fluid. In some embodiments, the aqueous base fluid comprises at least one of fresh water; brackish water; saltwater; and combinations thereof. The water may be fresh water, brackish water, saltwater, or any combination thereof. The displacement fluid may also be an oil-based fluid.

Activation Fluid

The activation fluid is any fluid that causes swelling of the swellable material. This fluid may contain water and/or hydrocarbon fluids (such as oil or gas). The activation fluid should be viscous enough so that it is capable of maintaining substantial separation between a prior placed fluid, such as a drilling fluid, and a cement composition. In one embodiment, the activation fluid is a water-based or oil-based fluid. One of skill in the art will be familiar with how the modification of fluids or "pills" to maintain separation between two different treatment fluids. The activation fluid may contain particles that cause the swellable material to swell. In one embodiment the activation fluid may be the cement system itself.

Wellbore and Formation

Broadly, a zone refers to an interval of rock along a wellbore that is differentiated from surrounding rocks based on hydrocarbon content or other features, such as perforations or other fluid communication with the wellbore, faults, or fractures. As used herein, into a well means introduced at least into and through the wellhead. According to various techniques known in the art, equipment, tools, or well fluids can be directed from the wellhead into any desired portion of the wellbore. Additionally, a well fluid can be directed from a portion of the wellbore into the rock matrix of a zone.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Embodiments disclosed herein include:

A: A method of detecting the presence of a downhole fluid at a particular location in a wellbore comprising pumping an activating fluid into a wellbore comprising a pipe string casing; contacting a flow controlling device in the pipe string casing with the activating fluid, the flow controlling device located in the pipe string casing, and the flow controlling device comprising at least one swellable element, wherein upon activation, the at least one swellable element swells and partially or fully seals off the flow area of the flow controlling device, therefore, controlling at least one of flow rate, pressure, and combinations thereof; activating the at least one swellable element in the flow controlling device thereby creating an activated flow controlling device; blocking fluids or controlling the flow of fluids entering or leaving the casing with the activated flow controlling device; allowing the pressure to change; and detecting the pressure change.

B: A method of cementing in a wellbore comprising: pumping an activating fluid through an annulus between a pipe string and the wellbore or through the pipe string casing; pumping at least one of a cement slurry, resin-based fluid, and combinations thereof through an annulus between a pipe string and the wellbore or through the pipe string casing; contacting a flow controlling device in the pipe string casing with the activating fluid, the flow controlling device comprising at least one swellable element, wherein upon activation, the at least one swellable element swells and partially or fully seals off the flow area of the flow controlling device, therefore, controlling at least one of the flow rate, pressure, and combinations thereof; activating the at least one swellable element in the flow controlling device thereby creating an activated flow controlling device; and blocking or controlling the activating fluid with the activated flow controlling device.

C: An apparatus for blocking or controlling fluid flow in a wellbore, the apparatus comprising: a pipe string in a wellbore; and a flow controlling device in the pipe string casing, wherein the flow controlling device comprises at least one swellable element, wherein upon an activating trigger, the at least one swellable element swells and partially or fully seals off the flow area of the flow controlling device, thereby blocking or controlling the flow of fluids into or out of the pipe string.

D: A system for generating a pressure spike or pressure pulses when a downhole fluid is present at a particular location in a wellbore comprising an apparatus including a pipe string in the wellbore; and a flow controlling device in the pipe string casing near the bottom of the wellbore, wherein the valve comprises at least one swellable element, wherein upon an activating trigger, the at least one swellable element swells and partially or fully seals off the flow area of the flow controlling device, thereby blocking or controlling the flow of fluids into or out of the pipe string; pumping an activating fluid into the wellbore; pumping a downhole fluid into the wellbore; contacting a flow controlling device in the pipe string casing with the activating fluid; activating the at least one swellable element in the flow controlling device thereby creating an activated flow controlling device; blocking or controlling the flow of downhole or activating fluids entering or leaving the casing with the activated flow controlling device; and allowing the pressure to spike or pulse.

Each of embodiments A, B, C, and D may have one or more of the following additional elements in any combination: Element 1: wherein the flow controlling device is a valve. Element 2: wherein the at least one swellable element includes at least one of pH responsive materials, hydrogels, polyelectrolytes, and combinations thereof. Element 3: wherein the activating includes at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof. Element 4: wherein the detecting comprises monitoring the surface pressure for increases in pressure. Element 5: further comprising multiple flow controlling devices at different locations, resulting in a series of pressure pulses that are communicated to the surface as a result of multiple pressure events created by the multiple swelling multiple flow controlling devices. Element 6: wherein the flow controlling device is a collar valve or shoe valve, or any other type of valve located at any desired location within the casing string. Element 7: wherein the swellable element of the valve comprises swellable material on at least one of the head of the valve, the tail of the valve, and combinations thereof. Element 8: further comprising deactivating the swellable element. Element 9: wherein the deactivating comprises pumping a fluid into the wellbore that causes the shrinking of the swellable element. Element 10: wherein the at least one of cement slurry and resin based fluid and the activating fluid are pumped through the pipe string casing, and the at least one of cement slurry and resin based fluid is pumped before the activating fluid. Element 11: further comprising placing a cement plug in the casing between the pumping of the at least one of cement slurry and resin based fluid and the pumping of the activating fluid. Element 12: wherein the at least one of cement slurry and resin based fluid and the activating fluid are pumped through the annulus between the pipe string and the wellbore, and the activating fluid is pumped before the at least one of cement slurry and resin based fluid. Element 13: wherein the activating fluid is also the at least one of cement slurry and resin based fluid. Element 14: wherein the flow controlling device is a valve. Element 15: further comprising allowing the pressure to change and detecting the pressure change. Element 16: wherein the detecting comprises monitoring the surface pressure for increases in pressure. Element 17: further comprising multiple flow controlling devices at different locations, resulting in a series of pressure pulses that are communicated to the surface as a result of multiple pressure events created by the multiple swelling multiple flow controlling devices. Element 18: further comprising adjusting the flow of the at least one of cement slurry and resin based fluid when the surface pressure increases rapidly or a series of pressure pulses are communicated to surface. Element 19: further comprising at least one of stopping the flow of the at least one of cement slurry and resin based fluid, adjusting the flow of the at least one of cement slurry and resin based fluid, and combinations thereof. Element 20: further comprising pumping a displacement fluid through the annulus behind the at least one of cement slurry and resin based fluid before the at least one cement slurry and resin based fluid has contacted the flow controlling device. Element 21: wherein the at least one of cement slurry and resin based fluid comprises at least one of an additive, a tracer, and combinations thereof, that activates the at least one swellable element. Element 22: wherein the deactivating comprises pumping a fluid down the casing or the annulus that causes the shrinking of the swellable element. Element 23: further comprising detecting the pressure spike or pulse on the surface of the wellbore. Element 24: wherein the detection of the pressure spike or pulse indicates that a downhole fluid is present near a certain downhole location. Element 25: wherein the indication that the downhole fluid is present near a certain downhole location is performed without wired downhole communications.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A method of detecting the presence of a downhole fluid at a particular location in a wellbore comprising:

pumping an activating fluid into a wellbore comprising a pipe string casing;

contacting a flow controlling device in the pipe string casing with the activating fluid, the flow controlling device located in the pipe string casing, and the flow controlling device comprising at least one swellable element, wherein upon activation, the at least one swellable element swells and partially or fully seals off the flow area of the flow controlling device, therefore, controlling at least one of flow rate, pressure, and combinations thereof;

activating the at least one swellable element in the flow controlling device thereby creating an activated flow controlling device;

blocking fluids or controlling the flow of fluids entering or leaving the casing with the activated flow controlling device;

allowing the pressure to change;

detecting the pressure change; and deactivating the at least one swellable element.

2. The method of claim 1, wherein the flow controlling device is a valve.

3. The method of claim 2, wherein the swellable element of the valve comprises swellable material on at least one of the head of the valve, the tail of the valve, and combinations thereof.

4. The method of claim 1, wherein the at least one swellable element includes at least one of pH responsive materials, hydrogels, polyelectrolytes, and combinations thereof.

5. The method of claim 1, wherein the activating includes at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof.

6. The method of claim 1, wherein the detecting comprises monitoring the surface pressure for increases in pressure.

7. The method of claim 6, further comprising multiple flow controlling devices at different locations, resulting in a series of pressure pulses that are communicated to the surface as a result of multiple pressure events created by the multiple swelling multiple flow controlling devices.

8. The method of claim 1, wherein the flow controlling device is a collar valve or shoe valve, or any other type of valve located at any desired location within the casing string.

9. The method of claim 1, wherein the deactivating comprises pumping a fluid into the wellbore that causes the shrinking of the swellable element.

10. A method of cementing in a wellbore comprising:

pumping an activating fluid through an annulus between a pipe string and the wellbore or through a pipe string casing;

pumping at least one of a cement slurry, resin-based fluid, and combinations thereof through the annulus between the pipe string and the wellbore or through the pipe string casing;

contacting a flow controlling device in the pipe string casing with the activating fluid, the flow controlling device comprising at least one swellable element, wherein upon activation, the at least one swellable element swells and partially or fully seals off the flow area of the flow controlling device, therefore, controlling at least one of the flow rate, pressure, and combinations thereof;

activating the at least one swellable element in the flow controlling device thereby creating an activated flow controlling device;

blocking or controlling the activating fluid with the activated flow controlling device; and deactivating the at least one swellable element.

11. The method of claim 10, wherein the at least one of cement slurry and resin based fluid and the activating fluid are pumped through the pipe string casing, and the at least one of cement slurry and resin based fluid is pumped before the activating fluid.

12. The method of claim 11, further comprising placing a cement plug in the casing between the pumping of the at least one of cement slurry and resin based fluid and the pumping of the activating fluid.

13. The method of claim 10, wherein the at least one of cement slurry and resin based fluid and the activating fluid are pumped through the annulus between the pipe string and the wellbore, and the activating fluid is pumped before the at least one of cement slurry and resin based fluid.

14. The method of claim 13, wherein the activating fluid is also the at least one of cement slurry and resin based fluid.

15. The method of claim 14, wherein the at least one of cement slurry and resin based fluid comprises at least one of an additive, a tracer, and combinations thereof, that activates the at least one swellable element.

16. The method of claim 13, further comprising pumping a displacement fluid through the annulus behind the at least one of cement slurry and resin based fluid before the at least one cement slurry and resin based fluid has contacted the flow controlling device.

17. The method of claim 10, wherein the flow controlling device is a valve.

18. The method of claim 10, wherein the at least one swellable element includes at least one of pH responsive materials, hydrogels, polyelectrolytes, and combinations thereof.

19. The method of claim 10, wherein the activating includes at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof.

20. The method of claim 10, further comprising allowing the pressure to change and detecting the pressure change.

21. The method of claim 20, wherein the detecting comprises monitoring the surface pressure for increases in pressure.

22. The method of claim 21, further comprising multiple flow controlling devices at different locations, resulting in a series of pressure pulses that are communicated to the surface as a result of multiple pressure events created by the multiple swelling multiple flow controlling devices.

23. The method of claim 22, further comprising adjusting the flow of the at least one of cement slurry and resin based fluid when the surface pressure increases rapidly or a series of pressure pulses are communicated to surface.

24. The method of claim 22, further comprising at least one of stopping the flow of the at least one of cement slurry and resin based fluid, adjusting the flow of the at least one of cement slurry and resin based fluid, and combinations thereof.

25. The method of claim 10, wherein the flow controlling device is a collar valve or shoe valve, or any other type of valve located at any desired location within the casing string.

26. The method of claim 25, wherein the swellable element of the valve comprises swellable material on at least one of the head of the valve, the tail of the valve, and combinations thereof.

27. The method of claim 10, further comprising deactivating the swellable element.

28. The method of claim 27, wherein the deactivating comprises pumping a fluid down the casing or the annulus that causes the shrinking of the swellable element.

29. An apparatus for blocking or controlling fluid flow in a wellbore, the apparatus comprising:

a pipe string in a wellbore; and a flow controlling device in a pipe string casing, wherein the valve comprises at least one swellable element, wherein upon an activating trigger, the at least one swellable element swells and partially or fully seals off the flow area of the flow controlling device, thereby blocking or controlling the flow of fluids into or out of the pipe string, and then deactivating the at least one swellable element.

30. The apparatus of claim 29, wherein the at least one swellable element includes at least one of pH responsive materials, hydrogels, polyelectrolytes, and combinations thereof.

31. The apparatus of claim 29, wherein the activating trigger includes at least one trigger selected from pH change, oxidation and reduction, solvent exchange, ionic strength change, oil-based change, light irradiation, temperature change, physical deformation, magnetic field application, electric field application, microwave irradiation, temperature, pressure gradients, and combinations thereof.

32. The apparatus of claim 29, wherein the flow controlling device is a valve.

33. The apparatus of claim 32, wherein the swellable element of the valve comprises swellable material on at least one of the head of the valve, the tail of the valve, and combinations thereof.

34. A system for generating a pressure spike or pressure pulses when a downhole fluid is present at a particular location in a wellbore comprising:

an apparatus comprising:

a pipe string in the wellbore; and a flow controlling device in a pipe string casing near the bottom of the wellbore, wherein a valve comprises at least one swellable element, wherein upon an activating trigger, the at least one swellable element swells and partially or fully seals off the flow area of the flow controlling device, thereby: blocking or controlling the flow of fluids into or out of the pipe string; pumping an activating fluid into the wellbore; pumping the downhole fluid into the wellbore; contacting a flow controlling device in the pipe string casing with the activating fluid; activating the at least one sellable element in the flow controlling device, thereby creating an activated flow controlling device; blocking or controlling the flow of downhole or activating fluids entering or leaving the casing with the activated flow controlling device; allowing the pressure to spike or pulse; and deactivating the at least one swellable element.

35. The system of claim 34, wherein the pressure spike or pulse is detected on the surface of the wellbore.

36. The system of claim 35, wherein the detected pressure spike or pulse indicates that the downhole fluid is present near a certain downhole location.

37. The system of claim 36, wherein the indicated downhole fluid is detected without wired downhole communications.

* * * * *